United States Patent [19]

Brennenstuhl

[11] 4,091,764

[45] May 30, 1978

[54] APPARATUS FOR UNIFORMLY COATING OBJECTS WITH PARTICLES

[76] Inventor: Hugo Brennenstuhl, Seestr. 1-3, Tubingen-Pfrondorf, Germany

[21] Appl. No.: 726,555

[22] Filed: Sept. 27, 1976

[30] Foreign Application Priority Data

Sept. 30, 1975 Germany ..... 2543575

[51] Int. Cl.[2] ..... B05B 5/02

[52] U.S. Cl. ..... 118/621; 118/627; 427/25

[58] Field of Search ..... 118/621, 626, 627, 636; 428/25, 30, 180

[56] References Cited

U.S. PATENT DOCUMENTS

| | | | |
|---|---|---|---|
| 2,378,025 | 6/1945 | Melton et al. | 118/627 |
| 2,748,018 | 5/1956 | Miller | 118/626 X |
| 3,797,457 | 3/1974 | Bushnell | 118/636 |
| 3,905,785 | 9/1975 | Fabre | 118/634 X |

FOREIGN PATENT DOCUMENTS

| | | | |
|---|---|---|---|
| 57,829 | 9/1967 | Germany | 427/30 |

*Primary Examiner*—Mervin Stein
*Attorney, Agent, or Firm*—Watson, Cole, Grindle & Watson

[57] ABSTRACT

Objects moving through a coating chamber are coated with particles, flakes or fibres in a uniform manner as a result of the particles, flakes or fibres being fed to the coating chamber by a conveying system which includes a vibrating feeder box, a gravity duct, a vibrating conveyor channel, a T-shaped distributor body and a transducer located below the distributor body. The transducer includes insulated wires on the bottom leg thereof that convey an alternating current and electrodes which are capable of carrying a direct current to the moving objects to be coated which are themselves grounded. When the particles, flakes or fibres drop from the T-shaped distributor body to the vicinity of the transducer they become influenced by the alternating electrostatic field and rise up in swirls. They then become influenced by the direct electrostatic field between the electrodes and the objects to be coated and they move along the lines of flux to coat the objects uniformly.

11 Claims, 8 Drawing Figures

APPARATUS FOR UNIFORMLY COATING OBJECTS WITH PARTICLES

The present invention relates to an apparatus for coating objects with powdered or granular particles, flakes or fibres (hereinafter referred to as "particles"), whereby the particles are introduced into a coating chamber where they are distributed as uniformly as possible for deposition on the objects to be coated, and after the coating operation any unused particles are discharged and the coated objects are removed.

Known methods and apparatus require compressed air, radiating air or air blasts, and the use of mechanically rotating parts for the conveyance of the coating material through the coating apparatus. It is an object of the present invention to provide an improved and simplified arrangement whereby objects may be coated rapidly and easily during an essentially continuous operation, and for which neither an air blast (for example, of compressed or radiating air), nor any mechanically rotating parts are required.

SUMMARY OF THE INVENTION

According to the present invention there is provided a method of coating objects with particles wherein the particles are advanced to a coating chamber on feeder planes which are inclined in the direction of feeding and wherein the particles are thrown upwards, such that the particles are distributed substantially evenly and are then deposited on the objects to be coated, unused particles are then removed and the coated objects removed, whereby neither radiating air, air-streams, or compressed air, nor any mechanically rotating parts are involved with the feeding and/or removal of the particles or with their distribution.

According to the present invention there is also provided an apparatus for coating objects with particles comprising a feeding section through which the particles are passed to a coating section, the feeding section comprising a plurality of feeder planes which are inclined in the direction of feeding; means for throwing the particles upwards; a coating section including a coating chamber wherein the particles are deposited; means for removing unused particles; and a delivery section wherefrom the coated objects are removed.

DESCRIPTION OF THE DRAWINGS

An embodiment of the present invention will now be described by way of example only with reference to the accompanying drawings, in which.

DESCRIPTION OF PREFERRED EMBODIMENT

Figure 1:
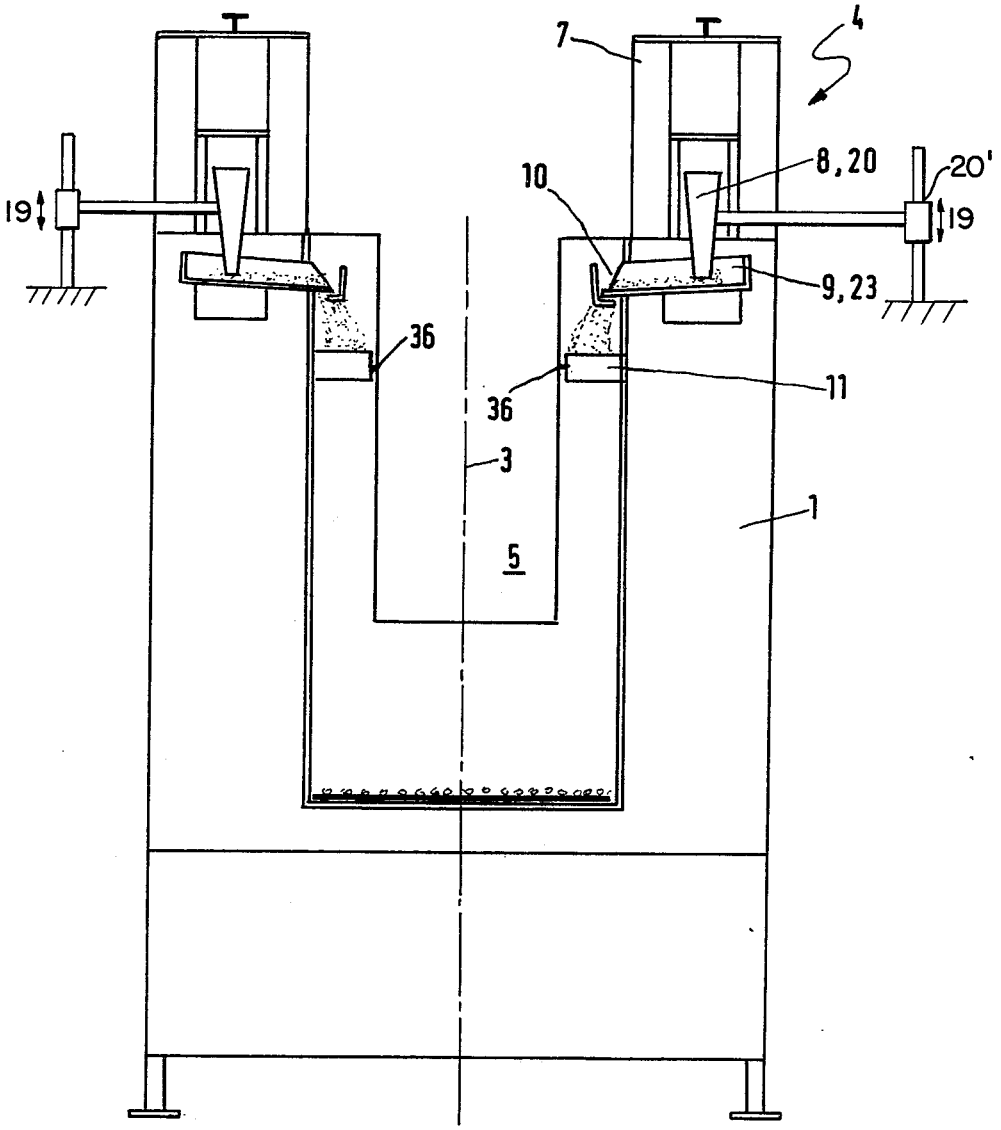
FIG. 1 is an apparatus according to the invention in elevation, depicting a front view.

The inventive apparatus for coating objects with particles consists of an axially extending elongate casing 1 through a central section of which are passed objects selected for coating, which are suspended from conveyor bands which advance approximately in the direction of the track indicated by arrow 3. The components of the coating apparatus include a loading section 4 for the feeding of the particles, i.e., the flakes or fibres, a coating section including a coating chamber 5 where the particles are deposited on the objects to be coated, and a delivery section 6 where the coated objects are removed from the apparatus. The loading section 4 includes feeder boxes 7, a gravity duct 8 connected with each feeder box which open into a conveyor channel 9, and a distributor body 10 which directs the material used for coating to an electrostatic transducer 11 from where the particles are hurled against the objects to be coated. The illustrations, especially FIGS. 1 and 2, indicate how the objects to be coated are carried through the central section of the casing to the coating chamber 5, i.e., the zone where the two shaped distributor bodies are located opposite one another, each shaped distributor body being associated with one of the longitudinal edges of the conveyor track.

In the embodiment shown in the drawings, the objects to be coated enter the apparatus at *2a* and leave the casing at *2b* after completion of their treatment. The objects are coated in an essentially known manner, the particles, carried on a supporting base, being shaken and whirled upwards by means of an alternating field which penetrates through an insulating base when passing through the region of electrostatic transducers, forming so to speak a cloud of particles which penetrates into a direct electrostatic field where the polarized particles are sped up in a direction towards the objects to be coated, and deposited on their surfaces, either by the effect of the forces of polarization or because the objects have been already coated, for example, with an adhesive substance. The adhesive properties may be enhanced by baking the particles into the surface. Unused particles may be recycled if desired, and the coated objects are conveyed out of the apparatus.

Since this method as just described is itself known, it may suffice to outline the principles of the method for the better understanding of the invention. As pointed out above, it is an object of the invention to simplify the process and the design of the apparatus, in order to achieve the procedure in a truly continuous method, by abandoning the previously employed air jets or blowers (in effect, the previously used pneumatic system) and by eliminating all mechanically rotating parts from the apparatus, and introducing instead a conveyor system as an aid for the feeding and/or discharge of the coating particles into the coating zone. The system consists of feeder planes which are inclined in the direction of feeding, along which the particles are carried and on which they are preferably thrown upwards either by causing the planes supporting the particles to vibrate or by exposing the particles to the effects of an alternating field.

The loading section of the apparatus in which the particles are fed into the chamber includes a feeder box 13 whose bottom 12 may vibrate under the action of an associated vibrator 15. Thus the feeder box, which is supported on bonded metal pads 14, is made to vibrate in a known manner, and transmits its vibrations into the coating material it contains. The base of the feeder box is inclined in the direction of feeding as indicated by the arrow 17, and the coating material 16, thrown upwards by the force of vibration, travels gradually along in the direction of the arrow 17. A passage 18 at the lowest part of the inclined bottom of the feeder box provides a connection with a gravity duct 20 which is mounted on the feeder box wall in a vertically adjustable manner (see, for example, means 20' in FIG. 1), as indicated by the arrow 19. This adjustment controls the admittance of the coating material as indicated by the arrow 21.

Figure 2:
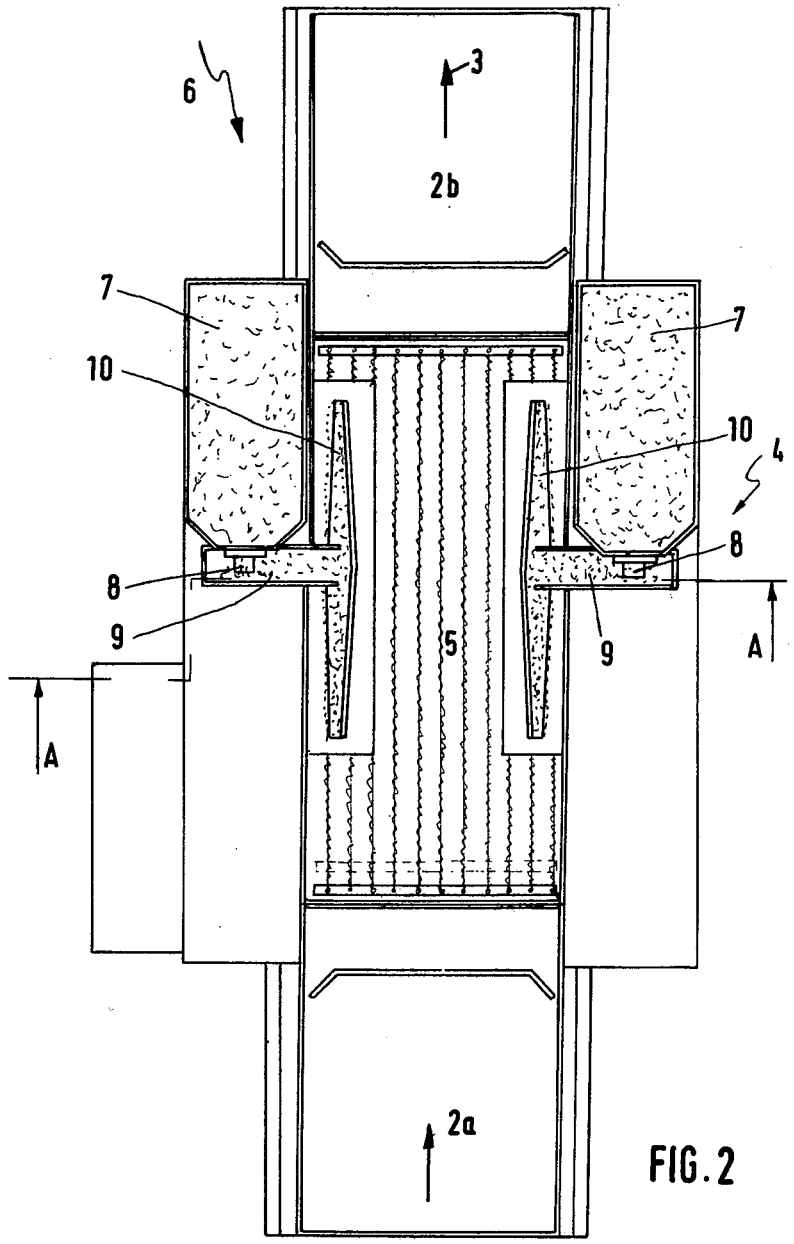
FIG. 2 is the apparatus of FIG. 1, in plan.
Figure 3:
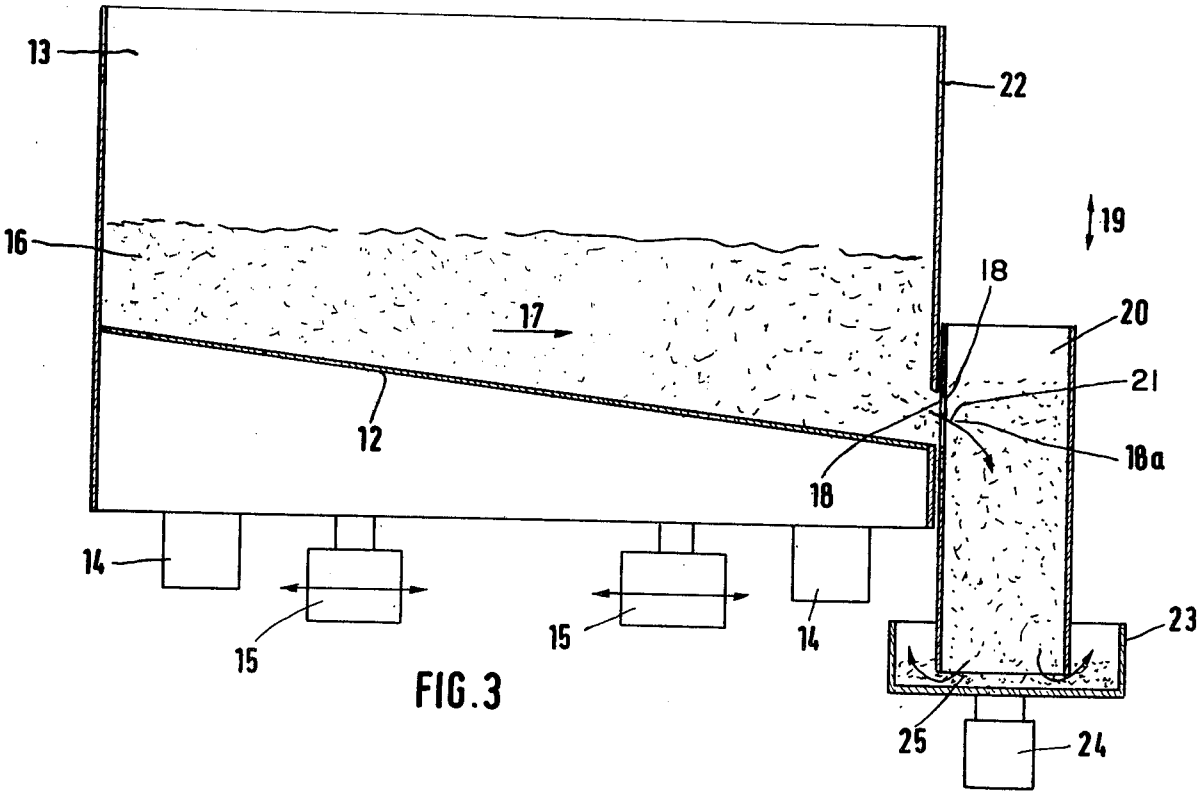
FIG. 3 is a feeder box including a gravity duct and conveyor channel, in elevation - schematic section.

The front section of the feeder box which contains the opening 18 may taper towards the front and towards the point where the base reaches its lowest level, for example, in the form of an arrow head. The gravity duct, mounted on the front wall 22 of the feeder box 13 in a vertically adjustable manner as indicated by the arrow 19, has an intake opening **18*a* in the wall adjacent to the feeder box, its size corresponding to that of the opening in the feeder box, with which it aligns when the adjustable duct assumes a given position. The gravity duct has a rectangular cross-section and is open at least at its lower end, so that the particles may drop through the duct into the conveyor channel 23 which is associated with the lower end of the gravity duct and extends normal to the latter and is likewise caused to vibrate under the effect of a throw-up vibrator 24. The width of a gap 25 between the lower, open end of the gravity duct and the bottom of the horizontal conveyor channel is variable and changes with each vertical adjustment of the gravity duct. As shown in FIG. 1**, the lower, open end of the gravity duct may be funnel shaped so that the mouth opposite the conveyor channel is small, and consequently admits relatively small quantities of the coating material into the channel, thus having a favorable effect on the distribution of the coating material carried in the channel. The conveyor channel extends at right angles to the forward direction in the feeder box, and also at right angles to the gravity duct. Its cross-section is rectangular and has the form of an open-topped trough or channel.

The rate of delivery is controlled by regulating the distance between the lower edge of the gravity duct and the bottom of the conveyor channel since this adjustment controls the cross-section of the passage, and the passage between the openings 18 and **18*a*** is fully closed when the gravity duct assumes its highest position, such that no particles will be admitted into the gravity duct. In this condition, the feeder box may be removed in order to be cleaned or replaced. The system is, moreover, protected by an inherent regulating function as explained below. The direction in which the conveyor channel carries the particles is perpendicular to the plan of the drawing. When the quantity of particles carried off by the conveyor channel is smaller than the quantity admitted into the gravity duct, the latter will be filled to a level above the opening in the feeder box, thus preventing the latter from delivering further particles into the vertical duct even though the feeder box continues to vibrate. Provided that the vibrations of the conveyor channel are constant, it will convey equal quantities of particles independently of the instantaneous particle head in the gravity duct, i.e., if the distance between the lower edge of the gravity duct and the bottom of the conveyor channel is correct. This means that a guarantee is given for a uniform charge since it can be ensured that the delivery of particles from the feeder box exceeds the rate at which particles are removed through the conveyor channel.

The vibrators are electrically coupled with the cut-off mechanism of the entire plant power. This means that the vibrators stop oscillating when the plant is switched off, so that the conveyance of particles is immediately stopped.

Figure 4:
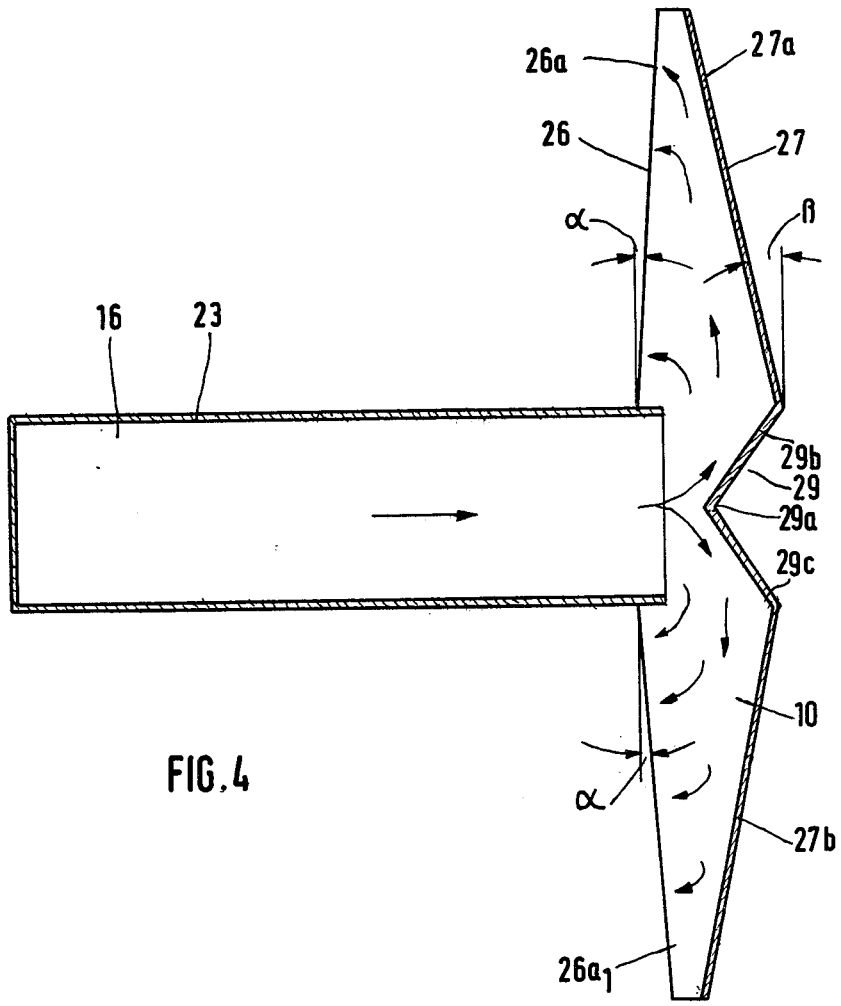
FIG. 4 is the conveyor channel with a shaped distributor body, schematically, in plan.

As mentioned above, the free end of the conveyor channel ends inside a shaped distributor body which extends across the channel end section, as shown in FIG. 4. The end section of the conveyor channel 23 which is remote from the feeder box (see FIG. 1) is open, and connects with the distributor body 10 which extends at right angles to both the conveyor channel and the gravity duct, and, as shown especially in FIG. 2, substantially parallel to one of the longitudinal edges of the track as indicated by the arrow 3. The shaped distributor body is symmetrical relative to the longitudinal axis of the conveyor channel (see FIG. 4), projecting from it on either side. In plan, the unit consisting of the distributor body and the conveyor channel has a T-shaped form whose cross web extends substantially parallel to the feeder box. The shaped distributor body (see FIG. 5) has an L-shaped cross section whose open side is adjacent to the conveyor channel 23. One leg 26 of the distributor body extends horizontally or substantially horizontally from the region of the free end of this channel, and projects from this channel in a plane underneath the base of the conveyor channel, preferably supporting it from below, while the other vertical leg 27 is located opposite to the open end of the channel, keeping a clearance 28 with the latter. An acute angle ($\alpha$) of 5° to 20°, measuring in a clockwise direction, is defined at either side between a limiting edge section **26*a*, 26*a*$_1$ of the lower, horizontal leg 26 of the L-shaped section facing the conveyor channel (see FIG. 4), and the normal to the longitudinal median axis of the conveyor channel, whereby the sections 26*a* and 26*a*$_1$ of the limiting edge 26 which extend to both sides have equal lengths and form an obtuse angle between 140° and 170°. The vertical leg 27 includes, in its middle section, an indentation 29 which is shaped like a symmetrical arrow head whose point 29*a* is located in the plane of the longitudinal median axis of the conveyor channel. Thus the vertical leg consists of two halves 27*a*, 27*b* each defining with the normal to the longitudinal median axis of the conveyor channel, an included acute angle ($\beta$) which, measured in the opposite direction from angle ($\alpha$), is again between 5° and 20° (or measured in the same direction as angle ($\alpha$), is an obtuse angle of 95° to 110°). The two sections 27*a* and 27*b* of the vertical leg 27, which extend from the conveyor channel to either side, have the same length and include an obtuse angle of 190° to 220°. The two symmetrical halves of the distributor bodies are immediately adjacent to the free ends of the legs 29*b*, 29*c*** of the arrow-shaped indentation, each forming with the legs an angle greater than 90°.

Since this distributor body is closed in the direction of conveyance, the particles travel along its surfaces and, subjected to the constant vibrations, drop off when reaching the shake-off edge 26, dropping downwards against the delivery direction of the conveyor channel. The geometry of the edge, and the shape of the distributor body are such that the shake-off along the edge is almost uniform, and the gradually tapering supporting surface of the horizontal leg of the shaped distributor results in a very even distribution of particles, preventing moreover particles from accumulating in the region of the distributor ends which otherwise might interfere with the distribution of the material and with the effects of vibration.

Figure 5:
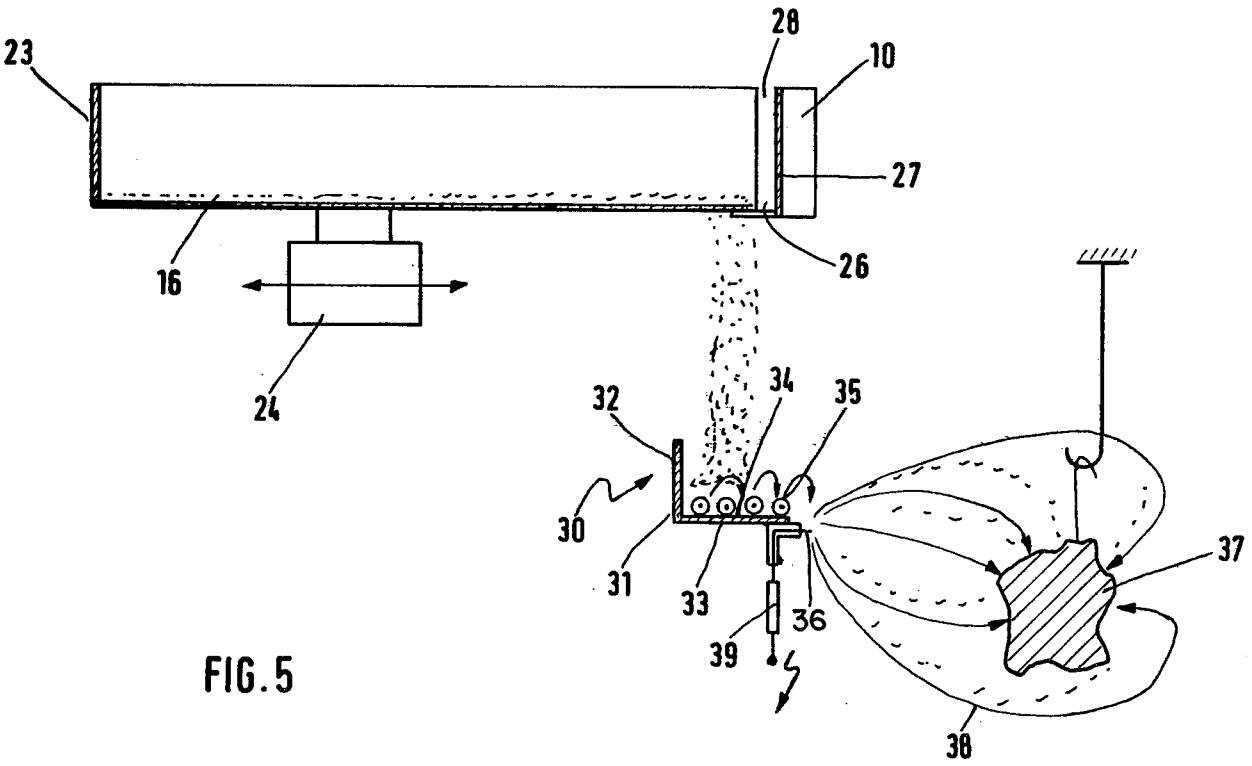
FIG. 5 is the conveyor channel with the shaped distributor body, an electrostatic transducer and a coated object, all in elevation.
Figure 6:
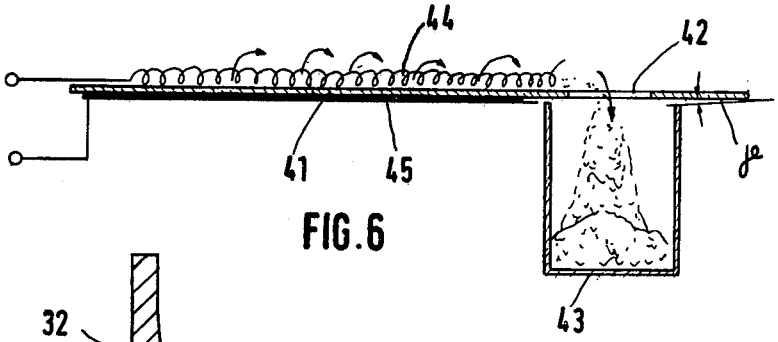
FIG. 6 is the bottom of the casing, in section.
Figure 7:
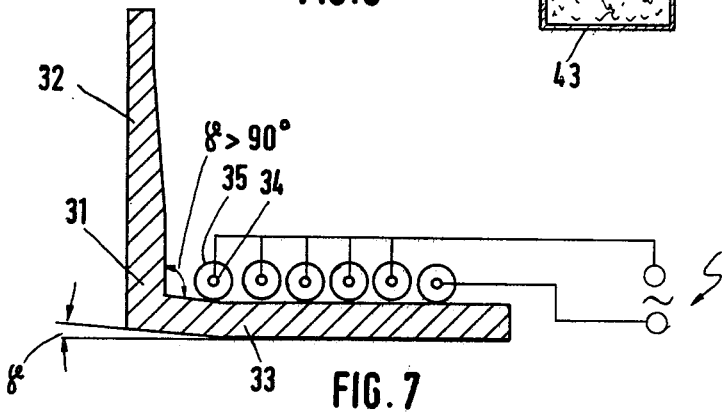
FIG. 7 is a detail of the arrangement shown in FIG. 5 in an enlarged scale presentation.

It has been explained above that the working section of the apparatus includes an electronic transducer 30 (see FIG. 5) which is located under the shaped distributor body (10) which influences the particles through the effects of an alternating electrostatic field, preferably of 6 to 16 kV, so that the particles shaken off the edge of the shaped distributor body and having dropped on to the associated insulating base, are caused to rise up again and to penetrate into a direct field whose lines of flux carry the particles towards the surface of the objects to be coated. The insulating base which has an L-shaped cross-section, is shown in FIGS. 5 and 7 according to which a vertical leg 32 is located on the side which is adjacent to the conveyor channel 23, and projects vertically upwards, while a substantially horizontal leg 33 lies underneath the horizontal part of the shaped distributor body. The angle $\gamma$ between the two legs 32 and 33 is wider than 90°, the leg 33 being inclined towards the objects to be coated 37, the respective angle $\delta$ relative to the horizontal being 5° to 20°.

The shape of the insulating base is favorable for the particle transport, facilitating it in a direction towards the coated object. Electrodes which are connected with the alternating field are carried on the upper surface of the leg 33, i.e., on the side of the L which is adjacent to the shaped distributor body, and comprise high-voltage insulated wires 34 as shown at 35, which extend parallel to each other and are alternatingly connected with the A.C. poles. The illustrations, especially FIG. 7, indicate that the insulated wires 34 on the insulating base 33 are alternatingly poled + or −. The advantage of this is that the insulation of the wires prevents high voltage arcing to the grounded objects. Apart from this, the construction of the electrostatic transducer is considerably simpler than that of similar known designs. The direct electrostatic field is developed in the zone between high voltage electrodes 36 in the vicinity of the insulated wires 34, which are connected with the alternating voltage poles, and the objects to be coated 37 which are grounded. The electrodes 36 consist of metal points protected by high-ohmic resistances 39 in series connection. It is shown, especially in FIG. 1, that the metal points which constitute the electrodes 36 project toward the objects to be coated.

The particles, shaken off in the distributor body in a broad front drop downwardly onto the electrostatic transducer where they are influenced by the alternating electrostatic field and consequently rise up, leaving the insulating base in a known manner. In the noted embodiment the high-voltage insulated wires are located on the same side of the insulating base, their connection being such that, for example, the first, third, and fifth, etc., wires are connected to positive voltage, and the second, fourth, etc., wires are connected to negative voltage.

The periodic pole reversal of preferbly 50 to 60 Hz leads to constantly changing conditions. The surface of the insulating layers, their environment, and especially the insulating base, therefore, reverse their polarity at the same frequency. As a result, any particles in contact with these parts develop forces of attraction and repulsion depending on the polarization of their immediate environment, which are effective not only between the particles themselves but also between the particles and the insulating base or the surfaces of the insulated wires. It is due to the resulting reciprocal repulsion and attraction between the particles, the insulating base, and the wire surfaces, that the particles are thrown up in vigorous whirls and there is therefore no need for additional mechanical aids. Particles which are thrown up as described above reach the direct electrostatic field between the high voltage electrodes 36 and the grounded objects 37 which are to be coated, and are carried along the lines of flux 38, reaching every point on the surface of the objects to be coated reached by these lines of flux. The electrodes 36 are metal points protected in a known manner by the series connected high ohmic resistance 39 against the danger of ignitable sparks arcing during short circuiting conditions. The objects may be coated from both sides as explained in connection with the illustrated embodiment, or from one side only.

A floor 41 of the casing of the coating chamber slopes down from the outer edge to a point in the middle zone where a passage 42 enables the particles to drop into a tank 43. This floor is constructed as an insulating base fitted on either side, i.e., above and below, with electrodes 44, 45 which are connected with a pulsating alternating field with superimposed direct voltage. The electrode above the insulating base is spirally shaped and the electrode beneath the base may be a plate-, strip-, or rod-electrode.

When objects are coated in a continuous process, greater quantities of particles are always sprayed than are required for coating. The surplus particles thus drop onto the spiral electrode 44 at the bottom of the coating chamber where they receive an impulse from a vertical surface so that they travel in the direction of the inclined floor and finally drop through the hole into the tank 43. There is, therefore, no danger of particles being mechanically brushed off and lost. The particles collected in the tank may be re-used.

Figure 8:
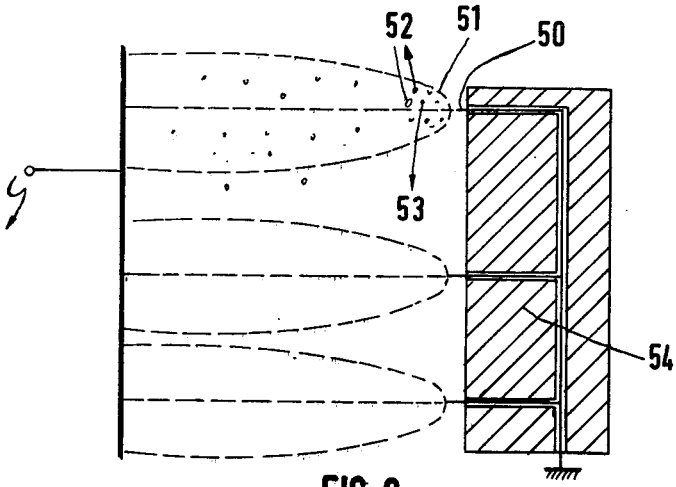
FIG. 8 is a beam-forming point electrode for the repulsion of particles collecting in whirls in the region of a casing aperture.

Since particles which are repelled by the electrostatic transducer or the insulating base tend to be distributed all over the place inside the casing because of their reciprocal repulsion, it is feasible that these particles might leave the chamber through the openings serving for the admittance or removal of the objects to be coated. This danger has been forstalled by a number of point electrodes being provided in the zones of these openings, for example, at the points where the objects to be coated enter, or the coated objects leave the chamber; these point electrodes serving for the repulsion of particles which whirl through the chamber, shown in FIG. 8. It is known that high field intensities, as indicated in 51 (FIG. 8) may develop at points 50 (FIG. 8) or edges, and that the respective field gradients are intense. If particles 52 having the same charge or polarization reach these zones of intense flux line density, they must repel each other violently, whereby the repulsive effect, according to the arrow 53, which exists between the individual particles, is more intense than the attraction between the particles and the point. This effect is enhanced either by connecting the points with high voltage when they are located in a grounded environment, or by grounding the points which are embedded in electrically isolating materials 54, the environment being built up of an insulating substance. By arranging a number of point electrodes of this type along the openings giving access or serving for delivery, so that these openings are as it were surrounded by electrodes, the particles as they follow the lines of flux emerge from the opening and approach each other to such an extent that they repel each other and turn each other back into the coating chamber. Thus, the particles are prevented from reaching the sections outside the coating chamber.

It is a further advantage of the invention that the changing of the particle color has been improved. Since all parts of the apparatus are designed as open units, all parts are easily accessible to be blown out, washed or rinsed, and the containers may be taken out to be cleaned or replaced when different colors are used.

The coating chamber can thus be continuously supplied with particles and this supply does not depend on the vigilance of an operator or on an expensive automatic control system. Nor are any mechanically rotating parts required for the conveyance of the particles to the coating chamber, their distribution, or the deposition on the objects to be coated. Only one power point for 220 V has to be provided. The particle transport can be continuously controlled by the regulation of the associated vibrators and there is no danger that particles might clog together in a system which vibrates continuously. Moreover, the previous recovery of material by means of expensive suction devices is no longer necessary. The changing of the color of the coating particles is still relatively simple (there are, for example, no hose connections which are difficult to clean, and all units in contact with the coating material are open and readily accessible for washing or blow cleaning).

Although my invention has been illustrated and described with reference to the preferred embodiments thereof, I wish to have it understood that it is in no way limited to the details of such embodiments, but is capable of numerous modifications within the scope of the appended claims.

Having thus fully disclosed my invention, what I claim is:

1. Apparatus for coating objects with particles comprising a feeding section and a coating section, said feeding section including a movable feeder box, a means connected to said feeder box to vibrate same, a gravity duct, a conveyor channel, a means connected to said conveyor channel to vibrate same, and a shaped distributor body;

said coating section including a coating chamber, a means for removing unused particles from said coating chamber, and a delivery means for removing coated objects from said coating chamber;

said movable feeder box including an inclined bottom wall and an end section having an opening therein, said bottom wall being inclined towards said opening in said end section to convey particles in said feeder box towards said opening;

said means connected to said feeder box to vibrate same being connected to said bottom wall thereof;

said gravity duct being generally vertically positioned to deliver particles passing through said opening in said end section of said feeder box to said conveyor channel, said conveyor channel extending at a right angle with respect to the particle feed direction through said gravity duct, said gravity duct being adjustable with respect to said opening in said end section of said feeder box, and said conveyor channel feeding particles into said shaped distributor body.

2. Apparatus according to claim 1 wherein said gravity duct comprises walls which taper to form a funnel-like passageway in the direction of said conveyor channel, wherein a wall thereof includes means forming an inlet opening which is the same size as, and is capable of registration with, said opening in said feeder box, and wherein means are provided for adjusting the positioning of said gravity duct to adjust the degree of registration between said inlet opening in said gravity duct and said opening in said feeder box.

3. Apparatus according to claim 2 wherein said means for adjusting the positioning of said gravity duct functions to move said gravity duct in a vertical direction and towards and away from said conveyor channel.

4. Apparatus according to claim 1, wherein said conveyor channel comprises means for providing an open-topped channel of rectangular cross-section, and which is positioned to extend at a right angle to the direction of inclination of said bottom wall of said feeder box, and which opens at one end into the shaped distributor body.

5. An apparatus according to claim 4, wherein the shaped distributor body is symmetrical relative to the longitudinal axis of the conveyor channel, extending on either side of the latter and which comprises means defining in plan view with the conveyor channel a T-shaped object, the distributor body extending substantially parallel with the feeder box, and having an L-shaped cross-section, the open side of the distributor body being adjacent to the conveyor channel with one leg of the L-shape being substantially horizontally disposed and extending in a plane below the open end of the conveyor channel and the other leg being substantially vertically disposed and located opposite to, but spaced from, the open end of the channel, and a central section of the distributor body having an indentation in the shape of a symmetrical arrow head whose point is aligned with the longitudinal axis of the conveyor channel.

6. Apparatus according to claim 5, wherein said one leg of the distributor body has a limiting edge which, on each side of the channel, includes, with the normal to the longitudinal axis of the conveyor channel, an acute angle in the range 5° to 20°, whereby the limiting edges on each side, which are of equal length, include between them an angle in the range 140° to 170°, and wherein said other leg of the L-shape, which deflects the particles in a direction opposite to the direction of feeding, is defined by two sections of equal length, each of which includes, with the normal to the longitudinal axis of the conveyor channel, an obtuse angle in the range 95° to 110°.

7. Apparatus according to claim 1, wherein an electrostatic transducer is located in the coating section underneath the shaped distributor body, by means of which the particles are affected by an alternating electrostatic field of 6 to 16 kV so that the particles, lying on an insulating base to which they are dropped out of the shaped distributor body, and which transducer is equipped on one side only with high tension insulated wires connected alternatingly to the poles of the alternating voltage system, are caused to rise up and enter into a direct electrostatic field to reach the objects to be coated by travelling along the lines of flux of said electrostatic field.

8. Apparatus according to claim 7, wherein the insulating base has an L-shaped cross-section, one leg of which is disposed vertically and extends toward the conveyor channel, and the other leg of which is disposed substantially horizontally underneath said one leg of the shaped distributor body, and wherein the high tension insulated wires are located on the side of said other leg of the insulating base which faces the distributor body, and are arranged parallel to each other, the legs of the insulating base including an angle greater than 90°, whereby said other leg is inclined towards the coated object at an angle between 5° and 20° relative to the horizontal.

9. Apparatus according to claim 7, wherein the direct electrostatic field is created between high voltage electrodes located in the vicinity of the high tension insulated wires and the grounded objects to be coated, said electrodes being defined by metal points which project towards the objects, high ohmic resistances being connected in series with the electrodes.

10. Apparatus according to claim 1, wherein said coating chamber includes a support casing, a floor of which in the coating section slopes downwardly from an outer edge towards a central area, said means for removing unused particles from said coating chamber comprising a tank positioned beneath said support casing, said central area containing an outlet means to allow the particles to drop into said tank beneath said casing, the floor comprising an insulating base provided on upper and lower surfaces with electrodes which are connected with a pulsating alternating field superimposed by direct voltage.

11. Apparatus according to claim 1, wherein point electrodes are provided in the region of openings through which the objects to be coated are admitted or the coated objects are removed from the coating chamber, the point electrodes surrounding said openings and serving for the repulsion of particles whirling through the coating section, the points of said electrodes being connected with high voltage and located in a grounded environment, or being grounded and embedded in an electrically insulating material.

* * * * *